United States Patent [19]

Magiera

[11] 3,977,679

[45] Aug. 31, 1976

[54] BOARD GAME APPARATUS

[75] Inventor: David L. Magiera, Hopkins, Minn.

[73] Assignee: Wicks & Nemer, P.A., Minneapolis, Minn.

[22] Filed: Feb. 18, 1975

[21] Appl. No.: 550,379

[52] U.S. Cl. ..... 273/134 D; 273/134 E; 273/134 GP; 273/141 R; 273/146; 273/134 AD

[51] Int. Cl.[2] ..... A63F 3/00

[58] Field of Search ..... 273/134

[56] References Cited

UNITED STATES PATENTS

| | | | |
|---|---|---|---|
| 1,125,867 | 1/1915 | Mohr | 273/134 E |
| 1,631,505 | 6/1927 | Samis | 273/134 AD |
| 3,433,483 | 3/1969 | Ellis | 273/134 AD |
| 3,831,946 | 8/1974 | Denalsky | 273/134 AD |

*Primary Examiner*—Delbert B. Lowe
*Attorney, Agent, or Firm*—Wicks & Nemer

[57] ABSTRACT

Board game apparatus is shown, in its preferred form, as including a game board having first and second sequential and continuous path segments arranged in a parallel and contiguous manner forming a movement path. Further included are first and second chance taking apparatus for determining movement of game markers representing individual players along the path segments. Chance taking apparatus is shown in a first preferred form as dice and shown in a second preferred form as spinner apparatus with both embodiments having members of a third set located on one chance taking apparatus and members of a fourth set located on a second chance taking apparatus. Each of the third and fourth sets are formed from the combination of a member of a first set comprised of dots as conventionally applied to dice in the first preferred embodiment and of the numerals 1–6 in the second preferred embodiment and a member of a second set comprised of a rough member and a smooth member in the first preferred embodiment and of a flocked member and a nonflocked member in the second preferred embodiment. Although the members of the third and fourth sets are formed from the combination of a member of the first set and a member of the second set, the third and fourth sets have no members in common and, therefore, their intersection is an empty set. The game board is synergistically related to the chance taking apparatus to allow the exciting and entertaining play of a board game apparatus.

10 Claims, 5 Drawing Figures

BOARD GAME APPARATUS

BACKGROUND

The present invention relates generally to a board game and more particularly to a board game including chance.

With the increasing amounts of leisure time available to persons generally in modern society, an increasing need has been felt for amusement devices to occupy such leisure time. A selected class of such amusement devices has been generally favored as providing substantial non-repetitive play, requiring logic and intelligent decision making during play, and generally maintaining a high degree of interest for an extended period of time. Board games are within this selected class.

SUMMARY

A preferred embodiment of the present invention includes a first path segment and a second path segment arranged in a parallel and contiguous manner forming a movement path. First and second chance taking apparatus are further included for determining the movement of each player's game marker, allowing the progression on the board.

It is thus a primary object of the present invention to provide a novel board game apparatus.

It is further an object of the present invention to provide such apparatus for allowing the play of a board game including chance.

These and further objects and advantages of the present invention become clearer in light of the following detailed description of an illustrative embodiment of this invention described in connection with the drawings.

DESCRIPTION

Figure 1:
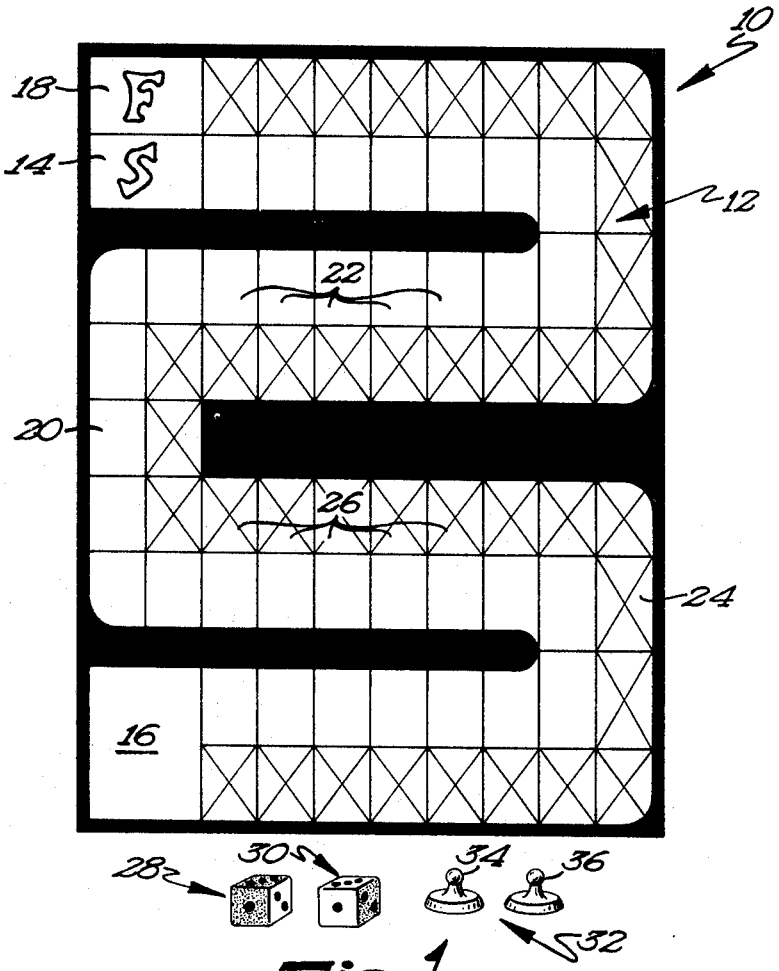
FIG. 1 shows a top plan view of a game board according to the present invention, including perspective views of various of the remaining apparatus for play of the board game.

In FIG. 1, a game board used in the board game apparatus of the present invention is shown and generally designated 10. Game board 10 includes a plurality of marked spaces, locations, or areas constituting a path progression about board 10, which path is generally designated 12. In particular, path 12 includes a start position 14, a median position 16, and a finish position 18. Start position 14 is connected to median position 16 by a first path segment 20. Path segment 20 includes a plurality of stepped locations 22 arranged sequentially and continuously to form a movement path. Median position 16 is connected to finish position 18 by a second path segment 24. Path segment 24 includes a plurality of stepped locations 26 arranged sequentially and continuously to form a movement path. In the preferred embodiment, path segment 20 is shown parallel with, adjacent to, and contiguous with, path segment 24. Also in the preferred embodiment, path segments 20 and 24 are arranged in a serpentine fashion on game board 10.

The board game apparatus further includes a first chance taking apparatus 28, shown in its first preferred form as a die, and second chance taking apparatus 30, also shown in its first preferred form as a die.

Also shown in FIG. 1 are a plurality of individual playing pieces, generally designated 32, shown as situated adjacent to board 10. Pieces 32 include separate playing pieces 34 and 36, which may be items specifically related to rules of the game, or any other items which can be separately identified.

Figure 2:
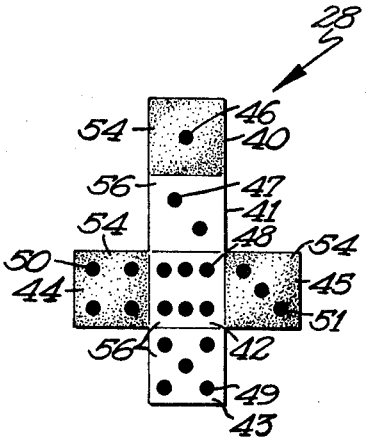
FIGS. 2 and 3 show planar views of three dimensional objects forming a part of the present invention as shown in FIG. 1.

First chance taking apparatus 28 is also generally shown in FIG. 2 as a die. Die 28 is cubical in shape including six outer faces 40–45. Generally, the die is used for randomly picking a member from a third set of identifiable members. The third set is formed from the combination of members of a first and a second set. Generally, the first set comprises a plurality of separately identifiable members 46–51, such as a series of dots as conventionally formed on dice, as shown, numerals, or similar members located on faces 40–45, respectively. The second set includes at least two separately identifiable members which are further separately identifiable from the members of the first set. In the preferred embodiment, the second set consists of either rough members 54 or smooth members 56.

Therefore, the third set of the preferred embodiment, as applied to die 28, includes the following members: a rough one dot separately identifiable member, a smooth two dot separately identifiable member, a rough three dot separately identifiable member, a rough four dot separately identifiable member, a smooth five dot separately identifiable member, and a smooth six dot separately identifiable member.

Figure 3:
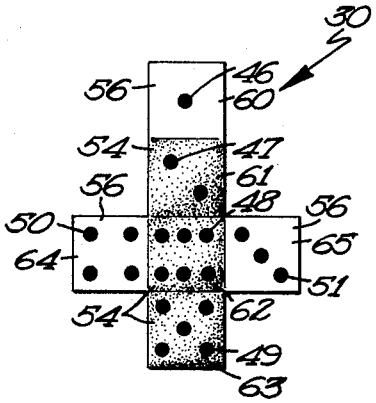

Second chance taking apparatus 30 is generally shown in FIG. 3 as a die. Die 30 is cubical in shape including six outer faces 60–65. Generally, die 30 is used for randomly picking a member from a fourth set of identifiable members. The fourth set is formed from the combination of members of a first and second set. Generally, the first set comprises a plurality of separately identifiable members 46–51, such as a series of dots as conventionally formed on dice, as shown, numerals, or similar members located on faces 60–65, respectively. The second set includes at least two separately identifiable members which are further separately identifiable from the members of the first set. In the preferred embodiment, the second set consists of either rough members 54 or smooth members 56.

Therefore, the fourth set of the preferred embodiment, as applied to die 30, includes the following members: a smooth one dot separately identifiable member, a rough two dot separately identifiable member, a smooth three dot separately identifiable member, a smooth four dot separately identifiable member, a rough five dot separately identifiable member, and a rough six dot separately identifiable member.

It should be noted that both the third and fourth sets are formed from the combination of a member of the first set and a member of the second set. However, the third set is the complement of the fourth set such that the intersection of the third set and the fourth set is an empty set, or in other words, the third and fourth sets have no members in common.

By rolling die 28, the member indicated by the vertical facing face on die 28 is the randomly chosen member of the third set. In a similar manner, by rolling die 30, the member indicated by the vertical facing face on die 30 is the randomly chosen member of the fourth set.

Figure 4:
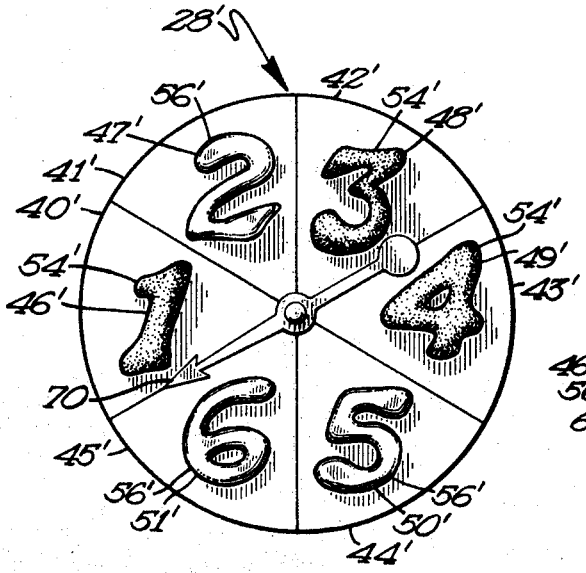
FIGS. 4 and 5 show alternate embodiments of FIGS. 2 and 3.
Figure 5:
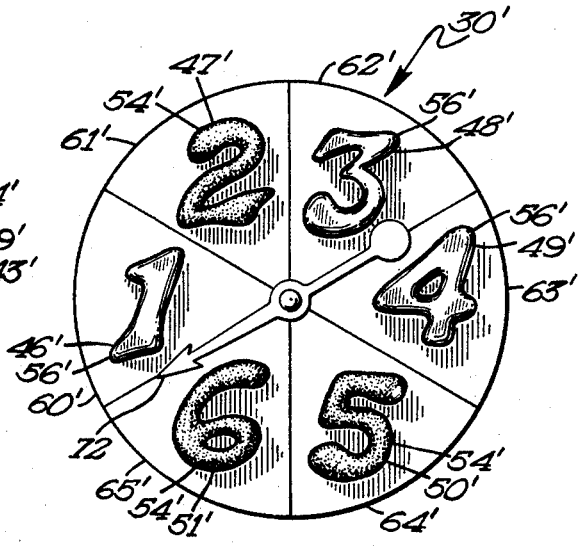

Alternate embodiments of chance taking apparatus 28' and 30' are generally shown in FIGS. 4 and 5 in the form of spinning apparatus. Spinners 28' and 30' generally include six wedge shaped areas 40' – 45' and 60' – 65', respectively, each including first separately identifiable members 46' – 51' shown as numerals and second separately identifiable members 54' and 56', shown as flocked and nonflocked, in a similar manner as rough and smooth members as applied to dice 28 and 30. Spinners 28' and 30' further include members 70 and 72, respectively, for indicating a member of the third and fourth set, respectively.

By spinning member 70, the member indicated by member 70 when it comes to a stationary position on spinner 28' is the randomly chosen member of the third set. In a similar manner, by spinning member 72, the member indicated by member 72 when it comes to a stationary position on spinner 30' is the randomly chosen member of the fourth set.

The objective of the board game apparatus of the present invention is to allow a play of a board game where game markers representing individual players attempt to progress along path segments 20 and 24 from the start position 14 to the finish position 18 with the movement on path segments 20 and 24 depending upon first and second chance taking apparatus 28 and 30. In the preferred embodiment, median position 16 acts as a safety base, in that a player cannot be set back beyond that point, or in other words, cannot be sent back from path segment 24 to path segment 20, as will be explained further hereinafter.

Each player is assigned a playing piece such as playing piece 34 or 36 as shown in FIG. 1. Each playing piece is then placed on start position 14. The game is begun with each player rolling die 28 to determine the starting player. In the preferred embodiment, the player obtaining the highest number on die 28 begins play followed by the remaining players in clockwise order.

The first player, assumed for the purpose of this description to have been assigned playing piece 34, is then ready to begin play. The player must first call his dice throw by predicting the outcome of the first and second chance taking apparatus and determine which strategy of play would be best in view of the location of the various playing pieces 32 on path 12. Possible dice throw calls are shown in the following table in reference to first chance taking apparatus 28 and second chance taking apparatus 30, shown in their preferred form as dice.

DICE THROW CALLS

1. ADVANCE — If dice 28 and 30 are both rough or both smooth, the player advances the total number of squares indicated by the total number of vertically facing dots on the dice.

2. SETBACK — If dice 28 and 30 are both rough or both smooth, an opponent of the player's choice is set back the total number of squares indicated by the total number of vertically facing dots on the dice.

3. ADVANCE ROUGH — The player advances the total number of squares indicated by the total number of dots on the vertically facing rough surfaces of dice 28 and 30 only.

4. SETBACK ROUGH — An opponent of the player's choice is set back the total number of squares indicated by the total number of dots on the vertically facing rough surfaces of dice 28 and 30 only.

5. ADVANCE SMOOTH — The player advances the total number of squares indicated by the total number of dots on the vertically facing smooth surfaces of dice 28 and 30, only.

6. SETBACK SMOOTH — An opponent of the player's choice is set back the total number of squares indicated by the total number of dots on the vertically facing smooth surfaces of dice 28 and 30, only.

7. SPLIT — If one die, of the first and second dice 28 and 30, has a vertically facing rough surface and the other die has a vertically facing smooth surface, the player advances the number of squares indicated by the number of dots of the vertically facing die having the greatest number of vertically facing dots and an opponent of the player is set back the total number of squares indicated by the number of dots of the vertical face of the other die. If both dice have the same number of vertically facing dots, the player and opponent move the same number of spaces in opposite directions.

8. DOUBLE SPLIT — If both dice have the same number of vertically facing dots and one die has a vertically facing rough surface and the other die has a vertically facing smooth surface, the player and opponent move 20 spaces in opposite directions.

After the player announces his dice throw call, he rolls dice 28 and 30 together. If the player correctly predicts the throw of dice 28 and 30, the player advances his playing piece 34 and/or sets back his opponent's playing piece according to the dice throw calls set out above. However, if the player incorrectly predicts the throw of dice 28 and 30, the player must wait for his next turn to try again.

For example, if the player announces the dice throw call of "DOUBLE SPLIT", and upon rolling dice 28 and 30, both dice show three vertically facing dots and one die has a vertically facing rough surface and the other die has a vertically facing smooth surface, as shown in FIG. 1, the player advances 20 spaces on path 12 and sets back an opponent of his choice 20 spaces also. However, if the dice do not show the same number of vertically facing dots, he loses his turn and the dice advance to the next player who continues play.

It will be immediately apparent that the operation of the present invention is similar for spinners 28' and 30', and the above explanation applies, with the subsitution of the primed numbers for the unprimed numbers used in the above explanation.

It can now be appreciated that each player attempts to advance from start position 14 to finish position 18 via path segments 20 and 24 while simultaneously preventing his opponent from reaching finish position 18. In the preferred embodiment, players who have advanced to path segment 24 cannot be set back beyond median position 16, which acts as a safe base, to path segment 20.

Thus since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description and all changes which come within the meaning and range of equivalency of the claims are intended to be embraced therein.

What is claimed is:

1. Board game apparatus comprising, in combination: a game board having locations arranged thereon forming a path, with the path formed of a first path segment and a second path segment which are arranged in a parallel and contiguous manner forming a movement path thereon; game markers for movement along the path on the board; and chance taking apparatus comprising, in conbination: a first set including a plurality of separately identifiable members, with the members of the first set providing information as to the number of game locations the game markers may be moved along the path; a second set including at least two separately identifiable members which are further separately identifiable from the members of the first set; a third set including members formed from the combination of a member of the first set and a member of the second set; a fourth set including members formed from the combination of a member of the first set and a member of the second set, with the third set and the fourth set having no members in common; first means for randomly choosing a member of the third set; and second means for randomly choosing a member of the fourth set.

2. The apparatus of claim 1 wherein the members of the first set represent numerals.

3. The apparatus of claim 2 wherein the members of the second set are rough or smooth.

4. The apparatus of claim 3 wherein the first and second means are six sided objects, the third set contains six members, the fourth set contains six members, whereby each member of the third set is formed on a side of the first means and each member of the fourth set is formed on a side of the second means.

5. The apparatus of claim 1 wherein the first and second means are spinning apparatus including six wedge shaped members forming a circle, and a spinning member, the third set contains six members, the fourth set contains six members, whereby each member of the third set is formed on a wedge shaped member of the first means and each member of the fourth set is formed on a wedge shaped member of the second means.

6. The apparatus of claim 5 wherein the members of the second set are flocked or nonflocked.

7. The apparatus of claim 1 wherein the members of the second set are rough or smooth.

8. The apparatus of claim 1 wherein the members of the second set are flocked or nonflocked.

9. The apparatus of claim 1 wherein the first and second means are six sided objects, the third set contains six members, the fourth set contains six members, whereby each member of the third set is formed on a side of the first means and each member of the fourth set is formed on a side of a second means.

10. The apparatus of claim 1 wherein the first and second path segments are arranged in a serpentine fashion on the game board.

* * * * *